US006256462B1

(12) United States Patent
Maeda et al.

(10) Patent No.: US 6,256,462 B1
(45) Date of Patent: Jul. 3, 2001

(54) IMAGE FORMATION APPARATUS AND CONTROL METHOD THEREOF

(75) Inventors: Yasushi Maeda; Naohisa Nagata, both of Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/413,464

(22) Filed: Oct. 6, 1999

(30) Foreign Application Priority Data

Oct. 9, 1998 (JP) ..... 10-287785
Oct. 19, 1998 (JP) ..... 10-296282

(51) Int. Cl.[7] ..... G03G 15/00; G03G 15/01; G03G 21/00

(52) U.S. Cl. ..... 399/71; 399/149; 399/343; 430/125

(58) Field of Search ..... 399/71, 77, 87, 399/149, 150, 48, 343, 358, 359; 430/125

(56) References Cited

U.S. PATENT DOCUMENTS 5,657,114 * 8/1997 Kitajima et al. ..... 399/71
5,740,493 * 4/1998 Otaki et al. ..... 399/71
5,915,150 * 6/1999 Kukimoto et al. ..... 399/149

* cited by examiner

*Primary Examiner*—Sophia S. Chen
(74) *Attorney, Agent, or Firm*—Fitzpatrick, Cella, Harper & Scinto

(57) ABSTRACT

An image formation apparatus which includes an image formation unit for performing image formation by developing a latent image formed on an image support body in a printing job with use of a development unit and by transferring the developed image onto a fed recording medium, a collection unit for collecting a residual development agent on the image support body into the development unit, a detection unit for detecting a density of the image formed on the image support body, and a control unit for causing the collection unit to perform the residual development agent collection operation, according to the number of image formation of which image density detected by the detection unit exceeds a predetermined image density is provided.

40 Claims, 8 Drawing Sheets

IMAGE FORMATION APPARATUS AND CONTROL METHOD THEREOF

BACKGROUND OF THE INVENTION

1. Field of the Invention

The present invention relates to an image formation apparatus and a control method thereof which perform image formation by developing a latent image formed on an image support body with use of a development unit and then transferring the developed image onto a fed recording medium.

2. Related Background Art

Conventionally, an electrophotographic system has been known in a color image formation apparatus. In an image formation process of the electrophotographic system, initially, a photosensitive drum is uniformly charged by a charging unit, and an electrostatic latent image is formed by a laser or an LED (light emitting diode). Then the formed electrostatic latent image is developed by using toner to form a toner image, and the formed toner image is transferred onto a recording member such as a recording sheet of paper (referred as recording sheet hereinafter). Such an operation is performed for each of yellow (Y), magenta (M), cyan (C) and black (K), and the toner images for these colors disposed on the sheet are fixed thereto by heat, whereby a color image is formed. In this process, after the toner image is transferred onto the sheet, the residual toner on the photosensitive drum is eliminated by a cleaning unit.

It has been demanded in recent years to reduce a manufacturing cost of the color image formation apparatus and also to downsize the apparatus itself. For this reason, it has been proposed a so-called cleanerless apparatus in which any cleaning unit is not provided in the vicinity of the image support body such as the photosensitive drum.

In such the cleanerless apparatus, there are provided several methods to eliminate the residual toner on the photosensitive drum. In one method, for example, a contact-type charging unit disposed in the vicinity of the photosensitive drum once captures small-quantity residual toner on the drum after the transferring, changes an electrostatic characteristic of the captured toner, brings back the characteristic-changed toner to the drum, and then the development unit collects the brought-back toner and reuses it. According to such the method, it is controlled to collect the residual toner on the photosensitive drum during a printing job or during postrotation at the end of the printing job.

During sheet-to-sheet interval in the printing job or during the drum postrotation at the end of the printing job, the residual toner is captured by the charging unit, the captured toner is ejecting, and the ejected toner is then collected by the developing unit. However, in such operations, to eject the toner from the charging unit (i.e., to bring back the toner once captured by the charging unit to the photosensitive body) can not overtake. For this reason, the toner is mixed with a ferrite carrier acting as a dielectric brush in the charging unit, whereby it is impossible to maintain charging performance of the charging unit. As a result, there has been a problem that quality of a finally formed image is deteriorated.

In order to solve this problem, it has been thought to increase the frequency of cleaning operations. However, if the frequency of cleaning operations is increased, there occurs a problem that to unnecessarily perform the cleaning operation using the contact-type charging unit deteriorates the photosensitive drum.

In a case where it is necessary to collect the residual toner on one photosensitive drum during the printing Job, if the residual toners on the other drums are collected always at identical timing, an unnecessary cleaning operation is performed to the photosensitive drums for the colors other than black on condition that continuous printing is performed in a black/white mode and any image formation is not performed on the drums for the colors other than black. Thus, there occurs a problem that the photosensitive drum is deteriorated.

SUMMARY OF THE INVENTION

An object of the present invention is to provide an image formation apparatus which can solve the above-described problems.

Another object of the present invention is to provide an image formation apparatus comprising:

- an image formation means for performing image formation by developing a latent image formed on an image support body in a printing job with use of a development unit and by transferring the developed image onto a fed recording medium;
- a collection means for collecting a residual development agent on the image support body into the development unit;
- a detection means for detecting a density of the image formed on the image support body; and
- a control means for causing the collection means to perform the residual development agent collection operation, according to the number of image formation of which image density detected by the detection means exceeds a predetermined image density.

Still another object of the present invention is to provide an image formation apparatus comprising:

- an image formation means for each color for performing multi-color image formation by developing a latent image of corresponding color formed on corresponding one of plural different image support bodies in a printing job with use of a development unit for corresponding color and by transferring the developed image onto a fed recording medium;
- collection means for each color for collecting a residual development agent on the corresponding-color image support body into the corresponding-color development unit;
- plural detection means each for detecting a density of the image formed on the corresponding-color image support body; and
- control means for controlling the residual development agent collection operation by the collection means to the specific one image formation means or to the plural image formation means, according to an addition value of the image densities detected by the detection means.

Other objects and features of the present invention will become apparent from the following detailed description and the attached drawings.

DETAILED DESCRIPTION OF PREFERRED EMBODIMENTS

Hereinafter, a color image formation apparatus according to the present invention will be explained in detail with reference to the attached drawings.

First Embodiment

Figure 1:
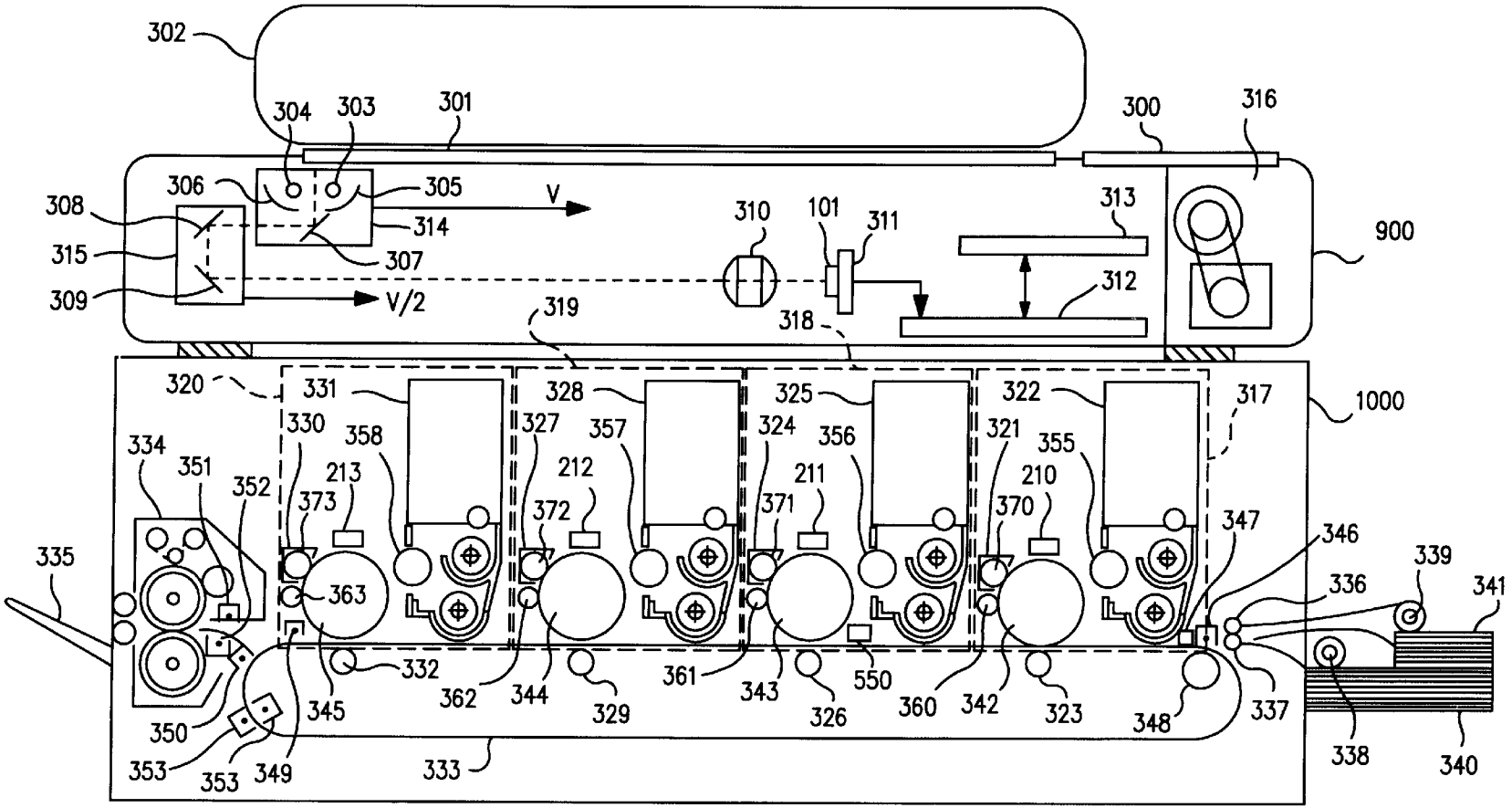
FIG. 1 is a sectional view showing the structure of an image formation apparatus according to the first embodiment of the present invention.

FIG. 1 is a sectional view showing the structure of the image formation apparatus according to the first embodiment of the present invention. The drawing specifically corresponds to a copying machine which consists of a color reader unit 900 and a color printer unit 1000.

(structure of color reader unit)

In the color reader unit 900, numeral 301 denotes an original mounting glass (referred as platen hereinafter) which is disposed at an upper portion of the unit 900. Numeral 302 denotes an DF (document feeder) which is disposed above the platen 301 and sequentially feeds original documents (merely referred as documents hereinafter) placed on a not-shown original mounting board to the platen 301. It should be noted that it is possible to dispose a not-shown mirror pressure board instead of the DF 302.

Numeral 314 denotes a first carriage which contains light sources (halogen lamps) 303 and 304, reflectors 305 and 306 for condensing light from the light sources 303 and 304, and a mirror 307 for reflecting light reflected or projected from the original.

Numeral 315 denotes a second carriage which contains mirrors 308 and 309 for condensing reflection light from the mirror 307 and further introducing the condensed light into a CCD (charge-coupled device) 101.

The CCD 101 converts the reflection light input through the mirrors 307, 308 and 309 and a lens 310 into an electrical signal. In a color sensor, a one-line CCD in which R (red), G (green) and B (blue) filters are disposed in line in that order, a three-line CCD in which R, G and B filters are disposed in respective lines, a CCD in which filters are disposed on one chip, or a CCD which has independent filters may be used as the CCD 101.

Numeral 311 denotes a base on which the CCD 101 is installed. Numeral 312 denotes a digital image process unit (merely referred as image process unit hereinafter) which includes later-described components except for the CCD 101 shown in FIG. 4, a later-described binary conversion unit 501 shown in FIG. 5, later-described video signal count units 520 to 523 shown in FIG. 5, later-described delay units 502 to 505 shown in FIG. 5, a not-shown CPU (central processing unit), a not-shown ROM (read-only memory), a not-shown RAM (random access memory), and the like. The CPU of the image process unit 312 entirely controls the copying machine on the basis of a program stored in the ROM. Numeral 313 denotes an I/F (interface) unit which acts as an interface for another IPU (image processing unit) or the like. Image information which was input from an external apparatus such as a host computer or the like through a predetermined communication means is transferred to the image process unit 312 by the I/F unit 313, whereby image formation can be performed by a color printer unit on the basis of the transferred information.

The first carriage 314 is mechanically moved by a drive unit 316 in a direction perpendicular to an electrical scanning direction (i.e., main scanning direction) of the CCD 101 at speed V. Also, the second carriage 315 is mechanically moved by the drive unit 316 in the same direction at speed V2. Thus, the face of the original is entirely scanned (i.e., in sub scanning direction).

(structure of color printer unit)

In the color printer unit 1000, numerals 317, 318, 319 and 320 denote an Y image formation unit, an M image formation unit, a C image formation unit and K image formation unit, respectively. The Y image formation unit 317 contains a photosensitive drum 342, a charger 321, an LED unit (or LED array) 210, a development unit 322, an auxiliary charger 360 and a transfer drum (or transfer charger) 323. The M image formation unit 318 contains a photosensitive drum 343, a charger 324, an LED unit 211, a development unit 325, an auxiliary charger 361 and a transfer drum (or transfer charger) 326. The C image formation unit 319 contains a photosensitive drum 344, a charger 327, an LED unit 212, a development unit 328, an auxiliary charger 362 and a transfer drum (or transfer charger) 329. The K image formation unit 320 contains a photosensitive drum 345, a charger 330, an LED unit 213, a development unit 331, an auxiliary charger 363 and a transfer drum (or transfer charger) 332.

The chargers 321, 324, 327 and 330 contain rotatively movable charging sleeves 370, 371, 372 and 373, respectively. Each of the sleeves 370, 371, 372 and 373 includes a not-shown magnetic field generation unit which generates a magnetic field by applying an AC bias voltage.

The development units 322, 325, 328 and 331 are provided with development sleeves 355, 356, 357 and 358, respectively. Each of the sleeves 355, 356, 357 and 358 includes a not-shown magnetic field generation unit which generates a magnetic field by applying an AC bias voltage.

Since the structures of the image formation units 317, 318, 319 and 320 are identical, only the Y image formation unit 317 will be explained in detail, and explanation of the other units will be omitted.

The auxiliary charger 360 and the charger 321 uniformly charges the surface of the photosensitive drum 342 to prepare latent image formation. The LED unit 210 forms the latent image on the drum 342 by using light. The development unit 322 develops the latent image on the surface of the drum 342 to form a toner image.

The transfer charger 323 which is disposed below the development unit 322 to pinch a transfer belt 333 discharges from the back side of the belt 333 to transfer the toner image on the photosensitive drum 342 to a recording sheet or the like on the belt 333.

Numeral 338 and 339 denotes pickup rollers which fed one by one transfer members such as the transfer sheets held in cassettes 340 and 341 onto the moving transfer belt 333 through sheet feed rollers 336 and 337, respectively. The feed rollers 336 and 337 once stop the transfer members fed by the pickup rollers 338 and 339 respectively, and then supply them onto the belt 333 at predetermined timing. Numeral 348 denotes a transfer belt roller which drives the transfer belt 333 disposed below the image formation units 317, 318, 319 and 320.

Numeral 346 denotes a charger which charges the recording sheet or the like to be fed to the transfer belt 333. Numeral 347 denotes a sheet leading edge sensor which detects the leading edge of the recording sheet fed to the transfer belt 333. A detection signal from the sensor 347 is transferred from the color printer unit 1000 to the color reader unit 900 to be used as a sub-scanning sync signal when a video signal is transferred from the unit 900 to the unit 1000.

Numeral 349 denotes a charge elimination charger which eliminates electric charge on the recording sheet or the like passed the K image formation unit 320. Numeral 350 denotes a separation charger which is disposed adjacent to the charge elimination charger 349 to prevent image derangement due to separation discharging occurred when the recording sheet or the like is separated from the transfer belt 333.

Numerals 351 and 352 denote prefixing chargers which charge the recording sheet or the like. Numeral 334 denotes a fixing unit which thermally fixing the toner image on the recording sheet after the sheet is charged by the chargers 351 and 352, and then discharges the sheet to a sheet discharge tray 335. Numerals 353 denote internal and external charge eliminators which eliminates electric charge on the transfer belt 333.

Hereinafter, operations of the respective units in the color printer unit 1000 will be explained.

Initially, the photosensitive drum 342 is charged by the auxiliary charger 360 and the charger 321. The surface of the drum 342 is uniformly charged by the charger 321 to prepare the latent image formation.

Next, the latent image is formed on the photosensitive drum 342 by the light from the LED array 210, and the formed latent image is developed by the development unit 322 to form the toner image.

The development unit 322 includes the development sleeve 355 which performs the development by applying a development bias voltage. The transfer charger 323 which is disposed below the development unit 322 to pinch the transfer belt 333 discharges from the back side of the belt 333 to transfer the toner image on the photosensitive drum 342 to the recording sheet or the like on the belt 333.

After the transfer is performed, developer (i.e., toner) residual on the photosensitive drum 342 is once captured by the charger 321 acting as a first collection means, an electrostatic characteristic of the captured developer is changed, and then the developer is again brought back to the drum 342. Then the developer is collected and reused by the development unit 322 acting as a second collection means.

Next, the procedure to form the image on the recording sheet or the like will be explained. The recording sheet or the like held in the cassette 340 or 341 is fed one by one with use of the pickup roller 338 or 339, and then the sheet is supplied onto the moving transfer belt 333 by the sheet feed roller 336 or 337. The transfer belt 333 which is disposed below the Y, M, C and K image formation units 317, 318, 319 and 320 is driven by the transfer belt roller 348.

The leading edge of the recording sheet fed to the transfer belt 333 is detected by the sheet leading edge sensor 347. The detection signal from the sensor 347 is transferred from the color printer unit to the color reader unit to be used as the sub-scanning sync signal when the video signal is transferred from the color reader unit to the color printer unit.

After then, the recording sheet is carried by the transfer belt 333, and thus Y, M, C and K toner images are sequentially formed on the sheet in that order by the image formation units 317, 318, 319 and 320.

The recording sheet passed the K image formation unit 320 is charge eliminated by the charge elimination charger 349 such that the sheet can be easily separated from the belt 333. Then the sheet is actually separated from the belt 333. The separation charger 350 is disposed adjacent to the charge elimination charger 349 to prevent image derangement due to separation discharging occurred when the recording sheet is separated from the transfer belt 333.

In order to compensate for adsorption of the toner and prevent the image derangement, the separated recording sheet is charged by the prefixing chargers 351 and 352, the toner image is thermally fixed by the fixing unit 334, and then the sheet with the fixed image is discharged onto the sheet discharge tray 335. Also, the transfer belt is charge eliminated by the internal and external charge eliminators 353.

Figure 2:
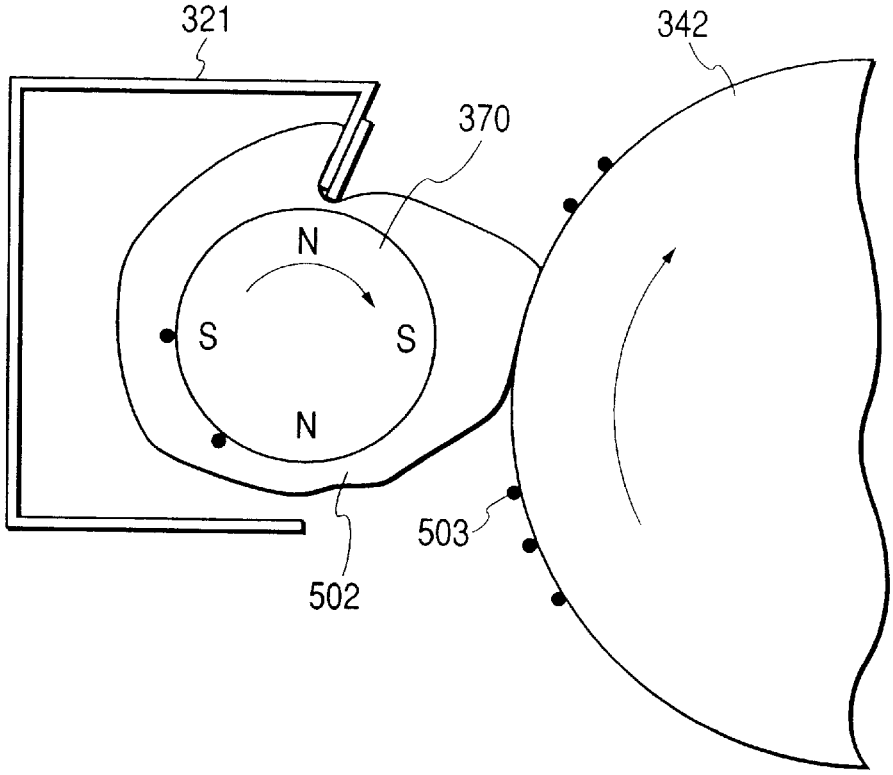
FIG. 2 is a sectional view for explaining the structure of a charger shown in FIG. 1.

FIG. 2 is a sectional view for explaining the structure of the charger shown in FIG. 1. In FIG. 2, the parts same as those in FIG. 1 are respectively added with the same numerals.

As shown in FIG. 2, by rotating the charging sleeve 370 along the direction reverse to the rotational direction of the photosensitive drum 342, the charger 321 forms a dielectric brush by a non-resistive ferrite carrier 502 to uniformly charge the surface of the drum 342 with charged particles, thereby preparing the latent image formation. Further, the charger 321 once captures toner 503 residual on the drum 342 after the image transferring is performed, changes the electrostatic characteristic of the toner, and again brings back it to the drum 342.

Figure 3:
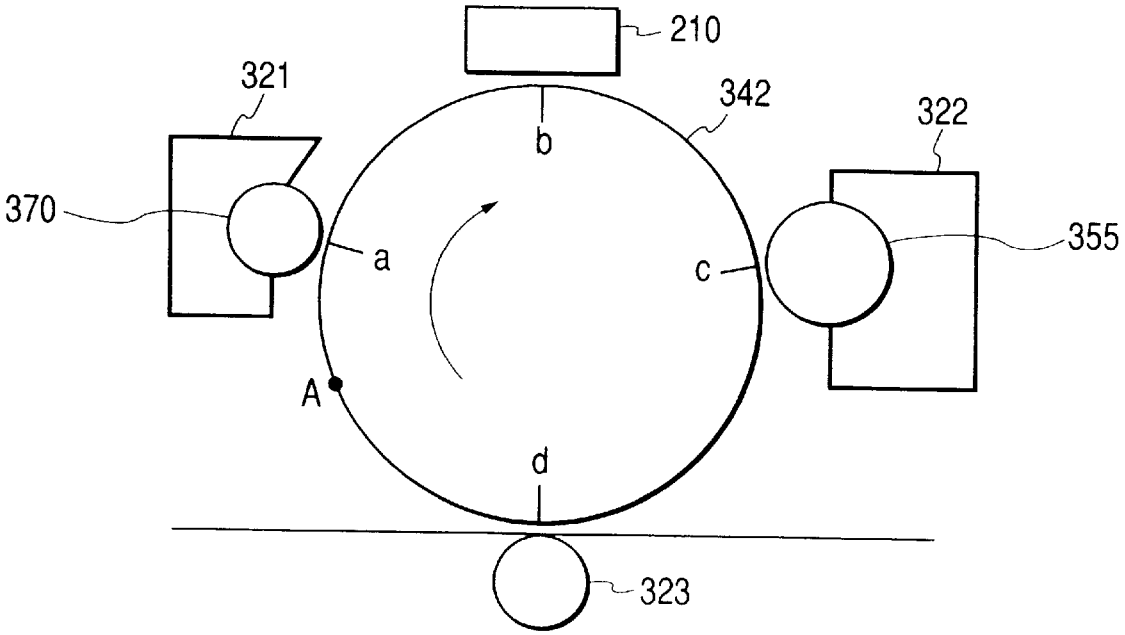
FIG. 3 is a sectional view for explaining the structure of the charger shown in FIG. 1.

FIG. 3 is a sectional view for explaining the structure of the charger shown in FIG. 1. In FIG. 3, the parts same as those in FIG. 1 are respectively added with the same numerals.

In FIG. 3, alphabetical symbol a denotes a charging position at which the charger 321 uniformly charges the surface of the photosensitive drum 342 to prepare the latent image formation. Alphabetical symbol b denotes an exposure position at which the LED 210 exposes the surface of the drum 342 to form the electrostatic latent image. Alphabetical symbol c denotes a development position at which the development sleeve 355 of the development unit 322 develops the electrostatic latent image on the surface of the drum 342 with use of the developer to form the developer image. Alphabetical symbol d denotes a transfer position at which the transfer charger 323 transfers the developer image on the surface of the drum 342 to the recording sheet or the like.

As shown in FIG. 3, the charger 321 uniformly charges the surface of the photosensitive drum 342 at the charging position a to prepare the latent image formation. Then the LED 210 exposes the surface of the drum 342 at the exposure position b to form the electrostatic latent image. Then the development sleeve 355 of the development unit 322 develops the electrostatic latent image on the surface of the drum 342 with use of the developer at the development position c to form the developer image. Then the transfer charger 323 transfers the developer image on the surface of the drum 342 to the recording sheet or the like at the transfer position d.

Figure 4:
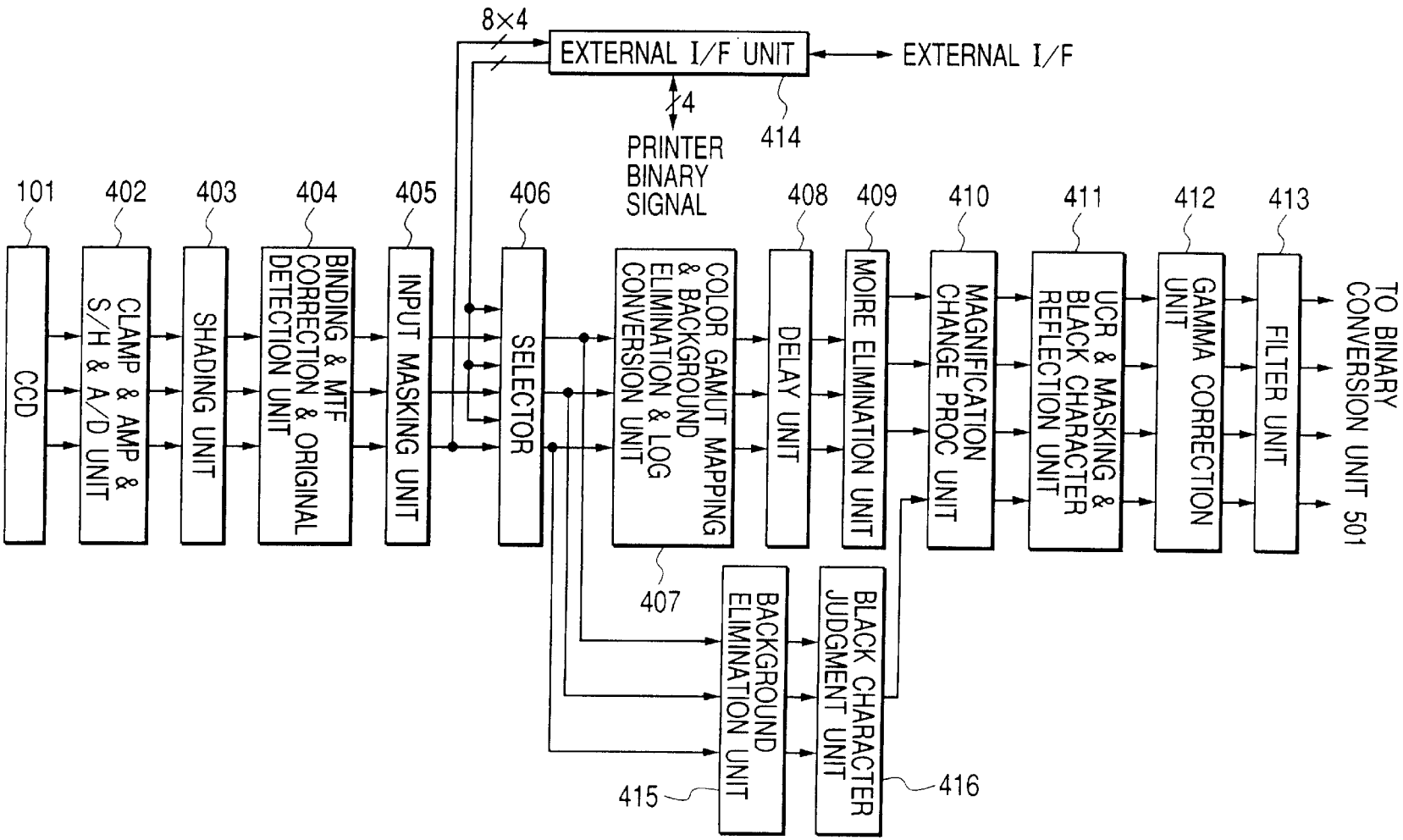
FIG. 4 is a block diagram showing the structure of a digital image process unit shown in FIG. 1.
Figure 5:
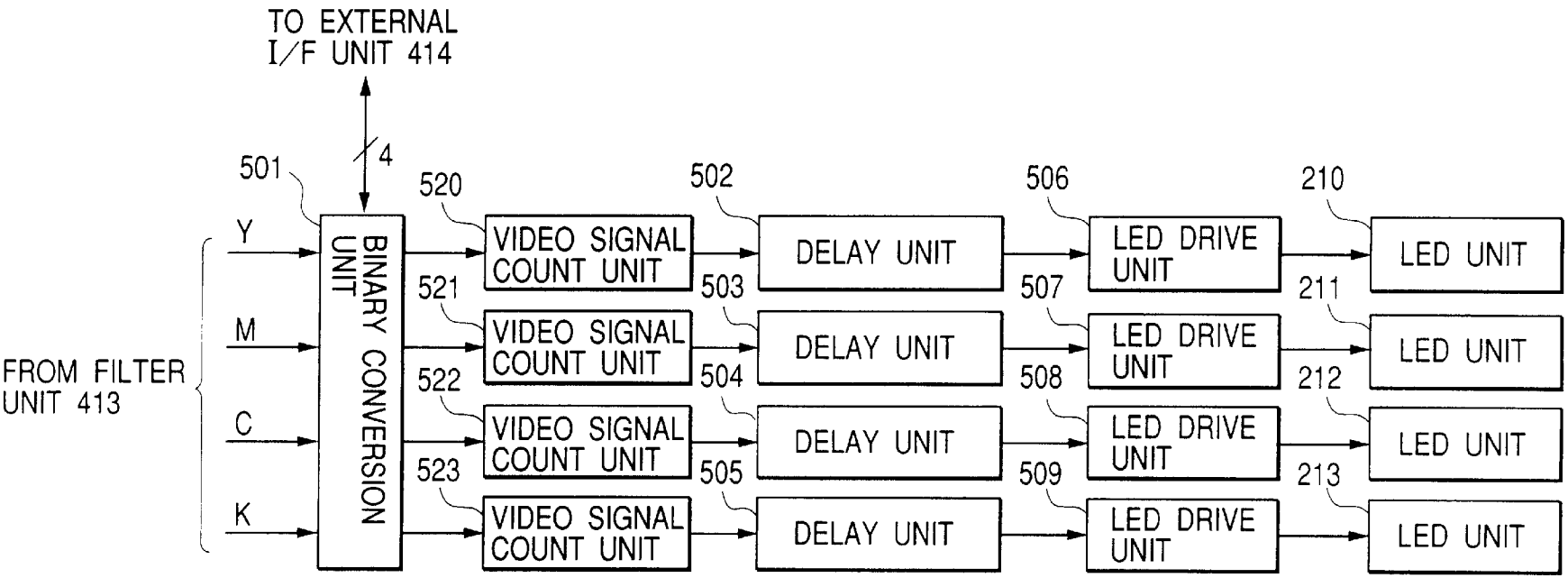
FIG. 5 is a block diagram showing the structure of the digital image process unit shown in FIG. 1.

FIGS. 4 and 5 are block diagrams showing the structure of the image process unit 312 shown in FIG. 1.

In the drawings, numeral 402 denotes a clamp and amplifier and SH (sample and hold) and A/D (analog-to-digital conversion) unit. The unit 402 performs a sample and hold process to electrical signals (i.e., analog image signal) converted from the reflection light of the original by the CCD 101, clamps a dark level of the analog image signal to reference potential, amplifies the potential by a predetermined quantity. It should be noted that the order of such processes is not limited to this. Namely, these processes may be performed in another order. Then the unit 402 performs AID conversion to convert the obtained signals into eight-bit R, G and B digital signals.

Numeral 403 denotes a shading unit which performs shading correction and black correction to the R, G and B signals input from the clamp and amplifier and SH and AD unit 402. Numeral 404 denotes a binding and MTF (modulation transfer function) correction and original detection unit. If the CCD 101 is the three-line CCD, image reading positions of the three lines are different from others. Therefore, the unit 404 performs a binding process to adjust a delay quantity for each line in accordance with reading speed, corrects signal timing such that the image reading positions of the three lines become identical. Since an MTF for the reading changes according to the reading speed and a magnification change rate, the unit 404 performs MTF correction to correct such a change. Then the unit 404 recognizes the size of the original on the platen.

Numeral 405 denotes an input masking unit which corrects a spectral characteristic of the CCD 101 and spectral characteristics of the light sources 303 and 304 and the reflectors 305 and 306, on the basis of the digital signals of which reading position timing have been corrected by the binding and MTF correction and original detection unit 404. The outputs of the input masking unit 405 are input to a selector 406. The selector 406 can change the inputs between the signals from the unit 405 and external I/F signals from an external I/F unit 414.

Numeral 415 denotes a background elimination unit which performs background elimination to signals output from the selector 406.

Numeral 416 denotes a black character judgment unit which judges whether or not a target character in the original is a black character, and generates a black character signal on the basis of the original.

Numeral 407 denotes a color gamut mapping and background elimination and logarithmic conversion unit which is composed of a color gamut mapping (or color space compression) unit, a background elimination unit and a logarithmic conversion unit. The color gamut mapping unit judges whether or not the read image signal is within a gamut capable of being reproduced by the printer. If the image is within the gamut, the gamut mapping unit retains the signal as it is. On the other hand, if the signal is not within the gamut, the unit corrects the signal to be within the gamut.

Then the background elimination unit performs a background elimination process, and the logarithmic conversion unit performs a logarithmic conversion to convert the R, G and B signals into C, M and Y signals.

Numeral 408 denotes a delay unit which adjusts timing of the output signals of the color gamut mapping and background elimination and logarithmic conversion unit 407 so as to match the timing of these signals and timing of the signal generated by the black character judgment unit 416. Numeral 409 denotes a moire elimination unit which eliminates moire of the above two kinds of signals (i.e., signal generated by unit 416 and output signal of unit 407). Numeral 410 denotes a magnification change process unit which performs a magnification change process in the main scanning direction.

Numeral 411 denotes an UCR (under color removal) and masking and black character reflection unit which is composed of an UCR unit, a masking unit and a black character reflection unit. The UCR unit performs an UCR process to the C, M and Y signals processed by the magnification change process unit 410 to generate the C, M, Y and K signals. Then the masking unit corrects these signals to be matched with the printer outputting, and the black character reflection unit feeds back the judgment signal generated by the black character judgment unit 416 to the C, M, Y and K signals.

Numeral 412 denotes a gamma correction unit which performs density adjustment to the signals processed by the UCR, and masking and black character reflection unit 411. Numeral 413 denotes a filter unit which performs a smoothing process or an edge process to the signals output from the gamma correction unit 412 and then outputs the processed signals to the binary conversion unit 501.

The eight-bit multivalue signals processed as above are converted into binary signals by the later-described binary conversion unit 501 (FIG. 5). As a conversion method in the unit 501, any of a dither method, an error diffusion method, and an improved error diffusion method can be used.

Next, in FIG. 5, the binary conversion unit 501 binarizes the signals from the filter unit 413. Numerals 520, 521, 522 and 523 denote the video signal count units which can count the number of light emission elements in the LED for each color image based on the signals input from the binary conversion unit 501.

Numerals 502, 503, 504 and 505 denote the delay units which delay the binarized image signals in accordance with distances between the sheet leading edge sensor 347 and the respective image formation positions. Numerals 506, 507, 508 and 509 denote the LED drive units which generate the signals to drive the LED units 210, 211, 212 and 213 respectively.

Hereinafter, an operation of each unit will be explained.

The light from the light sources 303 and 304 is reflected on the original put on the platen 301, introduced into the CCD 101, and converted into the electrical signal.

The converted electrical signal (i.e., analog image signal) is input to the image process unit 312. In the unit 312, by the clamp and amplifier and SH and A/D unit 402, the input signal is subjected to the sample and hold process, the dark level of the analog image signal is clamped to the reference potential, and the potential is amplified by the predetermined quantity. It should be noted that the order of such processes is not limited to this. Then the signal is subjected to the A/D conversion, thereby obtaining the eight-bit R, G and B digital signals.

The R, G and B signals are subjected to the shading correction and the black correction by the shading unit 403, and then subjected to the binding process by the binding and MTF correction and original detection unit 404. If the CCD 101 is the three-line CCD, the image reading positions of the three lines are different from others. Therefore, in the binding process, the delay quantity for each line is adjusted according to the reading speed, and the signal timing is corrected such that the image reading positions of the three lines become identical. Since the MTF for the reading changes according to the reading speed and the magnification change rate, the MTF correction is performed to correct such the change. Then the size of the original on the platen is recognized.

The digital signals of which reading position timing have been corrected are input to the input masking unit 405. In the unit 405, the spectral characteristic of the CCD 101 and the spectral characteristics of the light sources 303 and 304 and the reflectors 305 and 306 are corrected. The outputs of the input masking unit 405 are input to the selector 406 which can change the inputs between the signals from the unit 405 and the external I/F signals.

The signals output from the selector 406 are input to the color gamut mapping and background elimination and logarithmic conversion unit 407 and to the background elimination unit 415. The signals input to the unit 415 are subjected to the background elimination, and then input to the black character judgment unit which judges whether or not the target character in the original is the black character and generates the black character signal based on the original. On the other hand, it is judged based on the signals input to the unit 407 whether or not the read image signal is within the gamut capable of being reproduced by the printer. If the image is within the gamut, the unit 407 retains the signal as it is, while if the signal is not within the gamut, the unit 407 corrects the signal to be within the gamut. Then the background elimination process is performed, and the logarithmic conversion to convert the R, G and B signals into the C, M and Y signals is performed.

The timing of the signals output from the color gamut mapping and background elimination and logarithmic conversion unit 407 is adjusted such that it matches with the timing of the signal generated by the black character judgment unit 416. These two kinds of signals are subjected to the moire elimination by the moire elimination unit 409, and then subjected to the magnification change process in the main scanning direction by the magnification change process unit 410.

Then, in the UCR and masking and black character reflection unit 411, the C, M and Y signals processed by the magnification change process unit 410 are further subjected to the UCR process to generated the C, M, Y and K signals, and these signals are subjected to the masking process to be matched with the printer outputting. Further, the signal generated by the black character reflection unit 416 is fed back to the C, M, Y and K signals.

The signals processed by the unit 411 are then subjected to the density adjustment by the gamma correction unit 412, and then subjected to the smoothing process or the edge process by the filter unit 413.

Then the signals from the filter unit 413 are binarized by the binary conversion unit 501, and transferred to the video signal count units 520, 521, 522 and 523. In each of the units 520, 521, 522 and 523, the total number of light emission elements in the LED can be counted for each color image.

After then, the binarized image signals are delayed by the delay units 502, 503, 504 and 505 in accordance with the distances between the sheet leading edge sensor 347 and the respective image formation positions, and the delayed signals are transferred to the LED drive units 506, 507, 508 and 509 which generate the signals respectively to drive the LED units 210, 211, 212 and 213.

Next, a method to interrupt the printing job and eliminate the residual toner on the photosensitive drum (i.e., collect the toner and bring it back to the development unit) according to the image density will be explained in detail.

1. Method to detect image density

As the image density, the value which is obtained by dividing an area of the recording medium into the total number of light emission elements in the LED counted for each color image by the video signal count units 520 to 523 in FIG. 5 is used.

Figure 6:
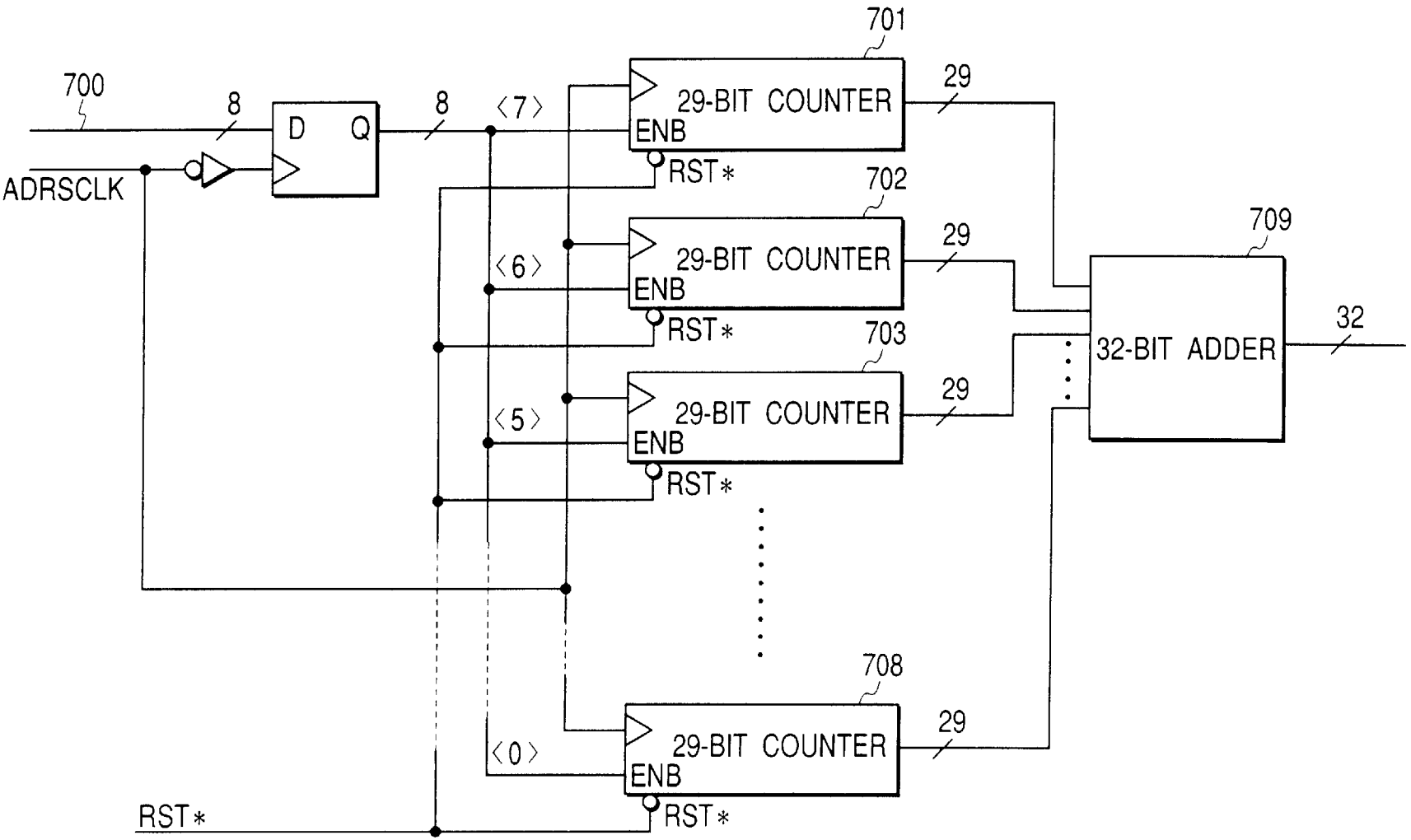
FIG. 6 is a block diagram showing the structure of a video signal count unit shown in FIG. 5.

FIG. 6 is a block diagram showing the structure of the video signal count unit 520 shown in FIG. 5. It should be noted that the structures of the video signal count units 521 to 523 are identical with that of the unit 520.

In FIG. 6, numeral 700 denotes an image signal which is transferred from the binary conversion unit 501. Numerals 701 to 708 denote 29-bit counters which count in parallel eight-bit image signals of one image obtained from the signal 700. Numeral 709 denotes a 32-bit adder which adds the counted results of the counters 701 to 708 to obtain the total number of light emission elements in the LED as 32-bit data.

Such a process is performed for each image formation to obtain the total number of light emission elements in the LED, the obtained number is divided by the area of the recording medium at that time, and the value obtained by such division is stored in a not-shown RAM of the image process unit 312 as the image density. Further, the number of images of which densities exceed a threshold value is counted, and also the image densities are added up. Then, when the counted number reaches a predetermined number, a flag is set in the not-shown RAM of the unit 312. At a time of registration ON (i.e., at timing of supplying the recording member onto the transfer belt 333 by the sheet feed rollers 336 and 337), if the flag stands, the printing job is temporarily interrupted until the flag is reset, and the residual toner elimination (i.e., collection) process described below is performed.

2. Method to eliminate (or collect) residual toner on photosensitive drum in temporary interruption of print job Hereinafter, the residual toner elimination (collection) process which is performed on the photosensitive drum when the flag representing that the number of images of which image densities exceed the threshold value reaches the predetermined number is set in the not-shown RAM in the image process unit 312 will be explained.

In order to clean off the residual toners on the photosensitive drums 342, 343, 344 and 345, the drums 342, 343, 344 and 345 are driven, e.g., a DC bias voltage of "−700V" and an AC bias voltage of "1.1 KVpp", "1 kHz" and "50%" duty rectangle wave are applied to the chargers 321, 324, 327 and 330 to drive the charging sleeves 370, 371, 372 and 373, and, e.g., a DC bias voltage of "−550V" and an AC bias voltage of "1 KVpp", "2.2 kHz" and "50%" duty rectangle wave are applied to the development units 322, 325, 328 and 331 to drive the charging sleeves 355, 356, 357 and 358, respectively.

By doing so, the chargers 321, 324, 327 and 330 once capture the toners on the photosensitive drums 342, 343, 344 and 345, change their electrostatic characteristics, and bring back them onto the drums 342, 343, 344 and 345, respectively. Then the development units 322, 325, 328 and 331 collect the respective toners.

Such a toner collection operation to be performed during the printing job is interrupted copes with a case where the toner captured by the charger is not sufficiently ejected in the high-density image formation. In addition, the charging sleeves 370, 371, 372 and 373 are rotatively driven in the state that only the AC bias voltage of the chargers 321, 324, 327 and 330 is OFF (i.e., in the state that magnetic field generation units in the sleeves are not driven) to eject the toners captured in the chargers. Then the development units 322, 325, 328 and 331 collect the respective toners.

As above, the AC and DC voltages are used as the bias voltages to be applied to the charger 321 (324, 327, 330). When applying the DC voltage, the toner in the charger is ejected to the photosensitive drum 342 (343, 344, 345), while when applying the AC voltage, the residual toner on the drum 342 (343, 344, 345) is attracted to the charger 321 (324, 327, 330).

Therefore, in case of mainly ejecting the toner remained in the charger 321 (324, 327, 330), only the AC voltage is OFF.

In the image formation apparatus according to the present embodiment, for example, if the image formation of which image density is 6% is performed, it is necessary to interrupt the printing job once per 1000 sheets and eject or discharge the residual toner in the charger.

Therefore, the image density values are added up, and the printing job is interrupted when the obtained value exceeds 6000 (6%×1000 sheets). However, if the image formation of which image density is 2% or less, since the latent image is completely transferred to a recording agent and thus the toner is hardly retained, the image density values are not added up.

If the residual toner elimination (collection) process ends, the flag (representing that the number of images of which image densities exceed the threshold value reaches the predetermined number) which has been set in the not-shown RAM of the image process unit 312 is reset.

After then, the printing job once interrupted restarts, whereby the recording member is supplied to the transfer belt 333 by the sheet feed rollers 336 and 337.

Hereinafter, a method to control the image formation apparatus according to the present invention will be explained with reference to FIGS. 7 and 8.

Figure 7:
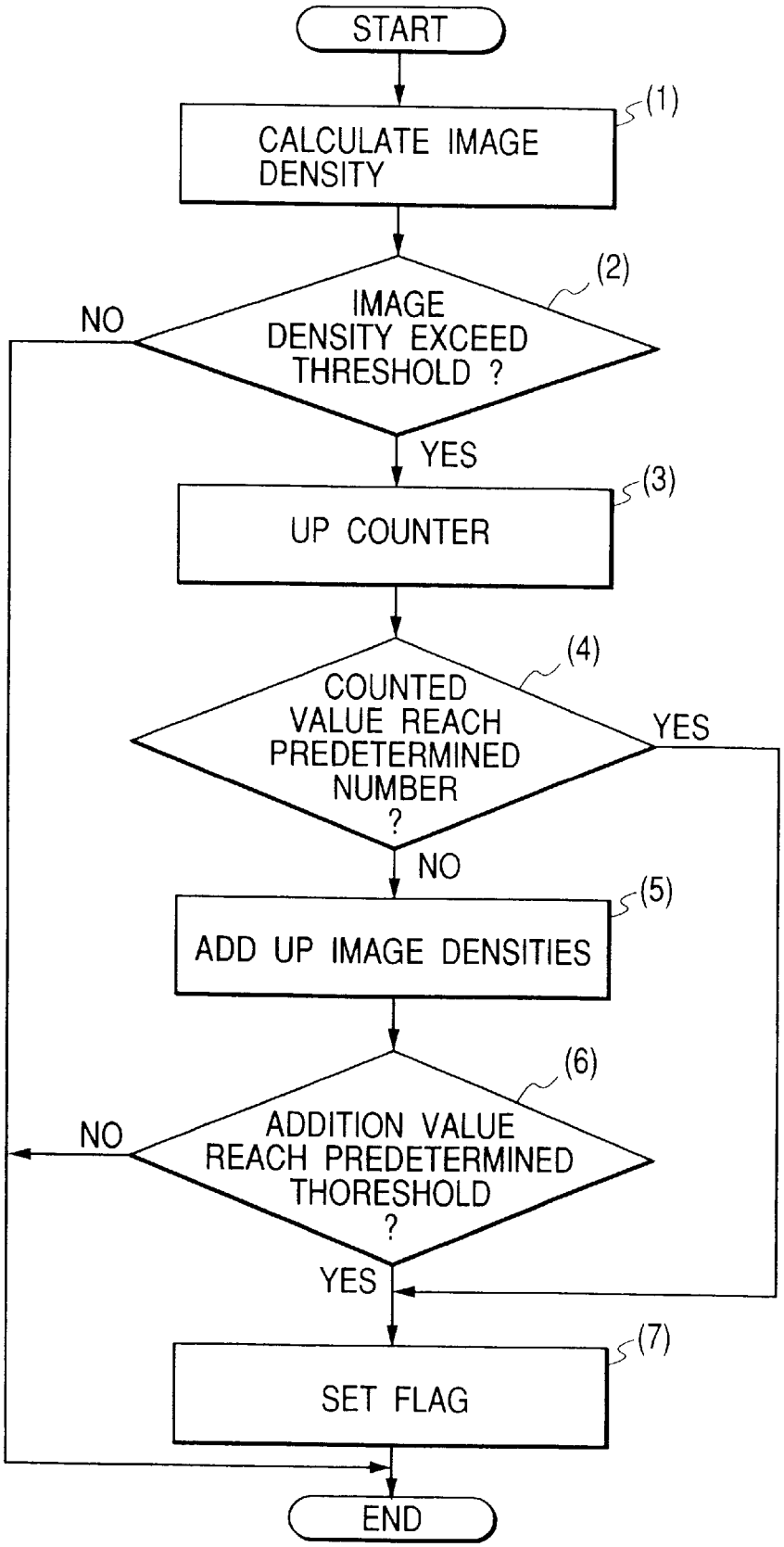
FIG. 7 is a flow chart showing a first control method of the image formation apparatus according to the first embodiment.

FIG. 7 is a flow chart showing a first control method of the image formation apparatus according to the present invention. The first control method corresponds to the image density detection process and is performed and controlled by a not-shown CPU of the image process unit 312 shown in FIG. 1 on the basis of a program stored in a ROM or another recording medium. In FIG. 7, numerals (1) to (7) represent respective steps.

Initially, if data representing the total number of light emission elements of the LED (referred as LED light emission element total number data hereinafter) is output from the 32-bit adder in each image formation, the LED light emission element total number data is divided by the area of the recording member at that time to calculate the image density (1).

Next, it is judged whether or not the image density exceeds the threshold value (2). If judged that the density does not exceed the threshold value, the process end, while if judged that the density exceeds the threshold value, the counter stored in the not-shown RAM of the image process unit 312 is counted up (3).

Next, it is judged whether or not the counted value reaches the predetermined number (4). If judged that the counted value reaches the predetermined number, the flow advances to a step (7).

On the other hand, if judged in the step (4) that the counted value does not reach the predetermined number, the addition value (i.e., the sum) of the image density is stored in the not-shown RAM of the image process unit 312 (5). Then it is judged whether or not the addition value reaches the predetermined threshold value (6). If judged that the addition value does not reach the predetermined threshold value, the process ends, while if the addition value reaches the predetermined threshold value, then the flag is set in the not-shown RAM of the image process unit 312 and also the addition value is cleared (7), and the process ends.

Figure 8:
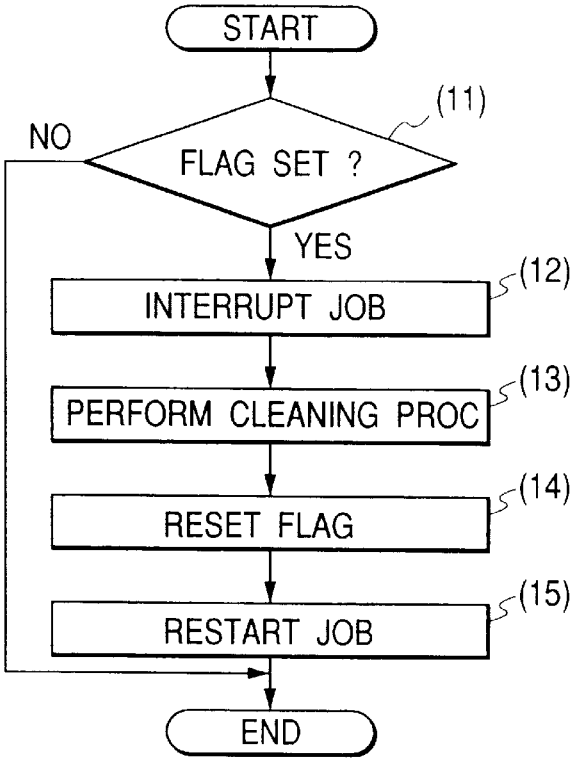
FIG. 8 is a flow chart showing a second control method of the image formation apparatus according to the first embodiment.

FIG. 8 is a flow chart showing a second control method of the image formation apparatus according to the present invention. The second control method corresponds to the residual toner elimination (collection) process on the photosensitive drum in the temporary interruption of the printing job and is performed and controlled by the not-shown CPU of the image process unit 312 shown in FIG. 1 on the basis of a program stored in the ROM or another recording medium. In FIG. 8, numerals (11) to (15) represent respective steps.

Initially, at the time of registration ON (i.e., at timing of supplying the recording member to the transfer belt 333 by the sheet feed rollers 336 and 337), it is judged whether or not the flag representing that the number of images of which image density exceeds the threshold value reaches the predetermined number is set (11). If judged that the flag is not set, the printing job is maintained as it is (i.e., starting to supply the recording member onto the transfer belt 333 by the sheet feed rollers 336 and 337).

On the other hand, if judged in the step (11) that such the flag is set, the printing job is temporarily interrupted (12), and the cleaning operation is performed (13).

If the cleaning operation ends, the flag (representing that the number of images of which image densities exceed the threshold value reaches the predetermined number) which has been set in the not-shown RAM of the image process unit 312 is reset (14). Then the printing job once interrupted in the step (12) restarts, whereby the recording member is supplied to the transfer belt 333 by the sheet feed rollers 336 and 337 (15).

By the above operation, in the image formation apparatus which does not have a cleaning-dedicated device, the residual toner elimination (collection) process on the photosensitive drum is performed at the timing determined according to the image density to eject the toner remaining in the charging unit. Thus, it is possible to prevent that the toner is mixed with the ferrite carrier acting as the dielectric brush in the charging unit, thereby maintaining the charging performance, preventing image deterioration, and providing a high-quality image. Also, since the toner elimination (collection) operation is performed at the timing according to the image density, it is possible to prevent deterioration of the photosensitive drum.

Further, since a development agent collected into each of the respective color development units during the residual toner elimination (collection) operation can be reused, it is possible to prevent that the development agent is used wastefully, thereby satisfactorily saving the development agents.

Modification of First Embodiment

In the above-described first embodiment, it is explained the case where the printing job is temporarily interrupted to perform the toner elimination (collection) process by judging the number of images of which densities exceed the predetermined image density and the addition value (the sum) of the image densities. However, it may be structured that a time necessary for the toner elimination (collection) process on the drum is changed according to the addition value of the image densities.

By doing so, it is possible to improve toner elimination (collection) process efficiency.

Further, in the first embodiment, it is explained the case where the image density is obtained by using the total number of light emission (i.e., video count) by the LED light emission elements of the image formation apparatus which causes the LED light emission elements to emit the light to form the latent image on the photosensitive member. However, in an apparatus which forms the latent image on the photosensitive body by scanning a laser beam, it may be structured that the image density is obtained by using the total number of laser lighting signals (i.e., video count).

Further, it may be structured that a potential sensor 550 is provided in the vicinity of the photosensitive drum to measure the potential on the drum, thereby obtaining the image density.

Further, in the first embodiment, it is explained the case where each color image is formed onto the corresponding one of the plural photosensitive drums, and the images of respective colors are superimposed to form the multi-color image. However, it may be structured that a monochrome image is formed onto one photosensitive drum and then the respective color images sequentially formed on that drum are face-sequentially superimposed to form the multi-color image.

Thus, in a color image formation apparatus wherein a dedicated cleaning device for an image support body is not disposed in the vicinity of that body, the density of the image to be formed is detected, a printing job is temporarily interrupted according to the number of image formation of which image densities exceed a predetermined value, and thus a residual toner elimination (collection) operation is forcedly performed. By doing so, in a case where the number of printing of which density exceeds a predetermined image density exceeds a predetermined number, it is possible to temporarily interrupt the printing job and perform the residual toner elimination (collection).

As above, in the color image formation apparatus which does not use the cleaning-dedicated device, by eliminating the residual toner on the photosensitive drum with the elimination (collection) operation according to the image density, it is possible to prevent that toner is mixed with a ferrite carrier acting as a dielectric brush in a charging unit, thereby maintaining charging performance. Further, since an unnecessary elimination (collection) operation is not performed, it is possible to prevent deterioration of the photosensitive drum.

Further, since a development agent collected into each of the respective color development units during the residual toner elimination (collection) operation can be reused, it is possible to prevent that the development agent is used wastefully, thereby satisfactorily saving the development agents.

According to the above-described first embodiment, the detection means detects the density of the image formed on the image support body by the printing job, and the control means interrupts the printing job and controls the residual development agent collection operation by the collection means in accordance with the number of image formation of which image density detected by the detection means exceeds the predetermined image density. Therefore, the unnecessary residual development agent collection operation is restricted, and the residual development agent collection operation is performed at the timing according to the image density, whereby it is possible to prevent deterioration of the image support body.

Further, the collection means includes the first collection means (charger (magnetic field generation means, sleeve, low-resistance carrier)) which once captures the residual development agent on the image support body, changes its electrostatic characteristic of the captured toner, and brings back the characteristic-changed development agent to the image support body, and the second collection means (development unit) which collects the brought-back development agent into the development unit of each color. Therefore, it is possible to prevent that the development agent is mixed with the ferrite carrier acting as the dielectric brush in the charger, thereby maintaining charging performance.

Further, in the residual development agent collection operation to be performed during interruption of the printing job, the control means controls the charger such that, after the charger ejects the once-captured development agent to the image support body, the charger further ejects the development agent by driving the sleeve in the state that the magnetic field generation means is not driven. Therefore, even in the residual development agent collection operation during interruption of the printing job, it is possible to sufficiently eject the development agent which was used in the high-density image formation and captured into the charger in the development agent collection operation. Thus, it is possible to prevent that the development agent is mixed with the ferrite carrier acting as the dielectric brush in the charger, thereby maintaining charging performance.

Further, the control means calculates the addition value of the image densities detected by the detection means, and then controls the time necessary for the residual development agent collection by the collection means in accordance with the addition value of the image densities calculated. Therefore, it is possible to improve efficiency in the development agent collection process.

Further, in the control method for the image formation apparatus which comprises the respective-color image formation means for developing the latent images formed on the different plural image support bodies for respective color components in the printing job with use of respective color development units and performing the multi-color image formation by transferring the developed latent images on the fed recording media and the respective-color collection means for collecting the residual development agents on the image support bodies into the respective development units, there are provided the detection step of detecting the image density to be formed on the image support body, and the collection step of interrupting the printing job and performing the residual development agent collection operation by the collection means in accordance with the number of image formation of which image densities detected in the detection step exceed the predetermined image density. Therefore, the unnecessary residual development agent collection operation is restricted, and the residual development agent collection operation is performed at the timing according to the image density, whereby it is possible to prevent deterioration of the image support body.

Therefore, it is possible to restrict the unnecessary residual development agent collection operation and prevent deterioration of the image support body, and also it is possible to maintain charging performance of the charger and form a high-quality image.

Second Embodiment

Subsequently, it will be explained in detail a case where a printing job is interrupted according to density of an image formed in any image support body, and it is determined based on the image support body caused such interruption whether a residual toner collection operation for the specific image support body is to be performed or a residual toner collection operation for the plural image support bodies is to be performed.

Hereinafter, the method to interrupt the printing job and determine based on the image support body caused the interruption whether the residual toner collection operation for the specific image support body is to be performed or the residual toner collection operation for the plural image support bodies is to be performed will be explained with reference to flow charts shown in FIGS. 9, 10 and 11. It should be noted that a hardware structure in the second embodiment is the same as that in the first embodiment shown in FIGS. 1 to 6.

Further, in the second embodiment, two means for interrupting the printing job are provided. One is to interrupt the printing job when an image density addition value for K (black) exceeds a predetermined value, and the other is to interrupt the printing job when any one of image density addition values for Y (yellow), M (magenta) and C (cyan) exceeds a predetermined value.

Figure 9:
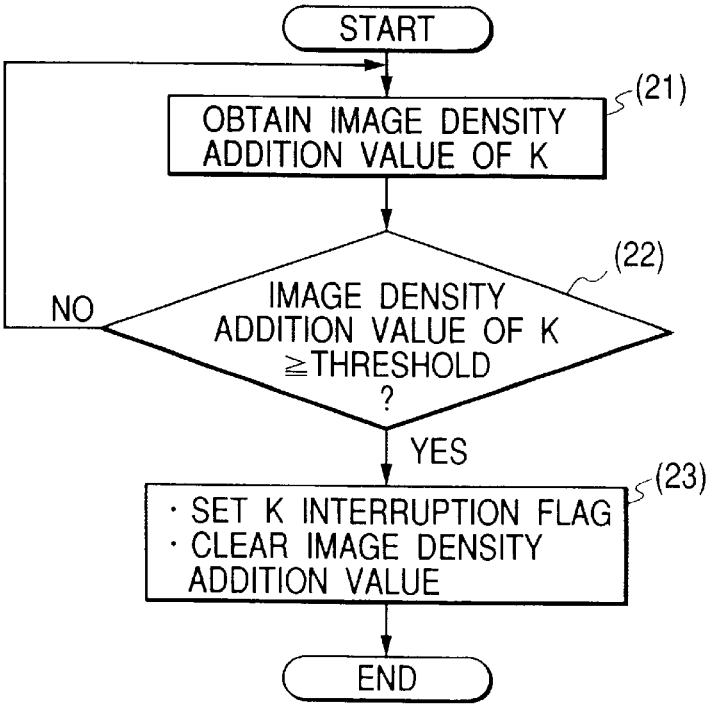
FIG. 9 is a flow chart showing a first control method of an image formation apparatus according to the second embodiment.

FIG. 9 is the flow chart showing a first control method of the image formation apparatus according to the second embodiment. The first control method corresponds to an image density detection process in a K image formation and is performed and controlled by a not-shown CPU of the image process unit 312 shown in FIG. 1 on the basis of a program stored in a ROM or another recording medium. In FIG. 9, numerals (21) to (23) represent respective steps.

Initially, in the K image formation, if data representing the total number of light emission elements of the LED (referred as LED light emission element total number data hereinafter) is output from the 32-bit adder 709 in the video signal count unit 523, the LED light emission element total number data is divided by the area of a recording member at that time to calculate a K image density, and a addition value DK of the K image density is stored in a not-shown RAM of the image process unit 312 (21). Then it is judged whether or not the addition value of the K image density reaches a predetermined threshold value, e.g., 6000 (22). If judged that the value does not reach the threshold value, the flow returns to the step (21), while if judged that the value reaches the threshold value, a K interruption flag is set in the not-shown RAM of the image process unit 312 and also the K addition value DK is cleared (23), and then the process ends.

Figure 10:
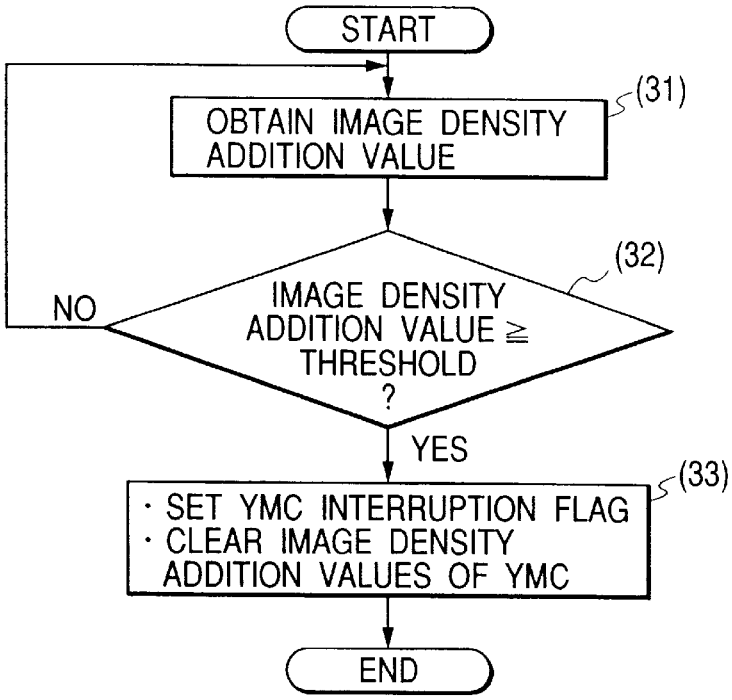
FIG. 10 is a flow chart showing a second control method of the image formation apparatus according to the second embodiment.

FIG. 10 is the flow chart showing a second control method of the image formation apparatus according to the second embodiment. The second control method corresponds to an image density detection process in Y, M and C image formation and is performed and controlled by the not-shown CPU of the image process unit 312 shown in FIG. 1 on the basis of a program stored in the ROM or another recording medium. In FIG. 10, numerals (31) to (33) represent respective steps.

Initially, in any of the Y, M and C image formation, if LED light emission element total number data is output from the 32-bit adder 709 in a video count unit corresponding to any of the video signal count units 520, 521 and 522, the LED light emission element total number data is divided by the area of a recording member at that time to calculate an image density of corresponding color, and a addition value (DY, DM, DC) of the corresponding color is stored in the not-shown RAM of the image process unit 312 (31). Then it is judged whether or not the addition value (DY, DM, DC) of the corresponding color reaches a predetermined threshold value, e.g., 6000 (32). If judged that the value does not reach the threshold value, the flow returns to the step (31), while if judged that the value reaches the threshold value, an YMCA interruption flag is set in the not-shown RAM of the image process unit 312 and also the Y addition value DY, the M addition value DM and the C addition value DC are cleared (33), and then the process ends.

Figure 11:
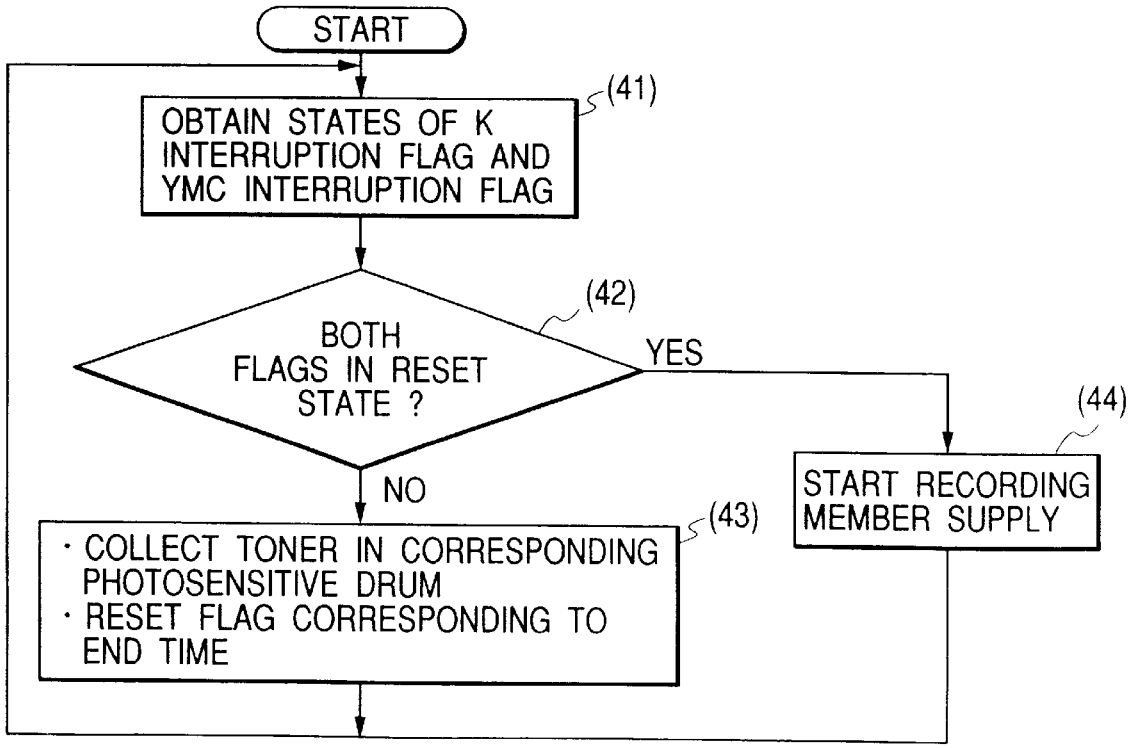
FIG. 11 is a flow chart showing a third control method of the image formation apparatus according to the second embodiment.

FIG. 11 is the flow chart showing a third control method of the image formation apparatus according to the second embodiment. The third control method corresponds to the residual tone collection operation control process at a time when a recording member is supplied, and is performed and controlled by the not-shown CPU of the image process unit 312 shown in FIG. 1 on the basis of a program stored in the ROM or another recording medium. In FIG. 11, numerals (41) to (44) represent respective steps.

Initially, in the case where the recording member is fed onto the transfer belt 333 by the sheet feed rollers 336 and 337, the state of the K interruption flag or the YMC interruption flag is obtained from the not-shown RAM of the image process unit 312 (41).

Then it is judged whether or not the obtained K interruption flag or the YMC interruption flag is in a reset state (42). If judged that the flag is in the reset state, the printing job is maintained as it is (i.e., starting to supply the recording member onto the transfer belt 333 by the sheet feed rollers 336 and 337) (44).

On the other hand, if judged in the step (42) that the flag is not in the reset state (i.e., in a set state), the printing job is temporarily interrupted, and the residual toner collection operation to the corresponding photosensitive drum is performed. Then, when the operation ends, the corresponding flag is reset, and the once-interrupted printing job is restarted (i.e., restarting to supply the recording member onto the transfer belt 333 by the sheet feed rollers 336 and 337)(43), and the flow returns to the step (41).

That is, when the K interruption flag is in the set state, the residual toner collection operation is performed only to the K photosensitive drum 345. Then, when the operation ends, the K interruption flag stored in the not-shown RAM of the image process unit 312 is reset, and the once-interrupted printing job is restarted (i.e., restarting to supply the recording member onto the transfer belt 333 by the sheet feed rollers 336 and 337), and the flow returns to the step (41).

On the other hand, when the YMC interruption flag is in the set state, the residual toner collection operation is performed to each of the Y, M and C photosensitive drums 342, 343 and 344. Then, when the operation ends, the YMC interruption flag stored in the not-shown RAM of the image process unit 312 is reset, and the once-interrupted printing job is restarted (i.e., restarting to supply the recording member onto the transfer belt 333 by the sheet feed rollers 336 and 337).

Modification of Second Embodiment

In the above-described second embodiment, it is explained the case where the residual toner collection operation for K and the residual toner collection operation for Y, M and C are independently performed in consideration of the fact that the Y, M and C image formation operations are not performed in a black and white mode. However, in a color image formation apparatus which form (i.e., print) a black image by using the Y, M and C photosensitive drums 342, 343 and 344, it may be structured that the residual toner collection operation for each of the Y, M and C photosensitive drums 342, 343 and 344 is performed when the image density addition value of any of Y, M and C exceeds the predetermined value.

Further, in the above embodiment, it is explained the case where the image density is obtained by using the total number of light emission (i.e., video count) by the LED light emission elements of the image formation apparatus which causes the LED light emission elements to emit the light to form the latent image on the photosensitive member. However, in the apparatus which forms the latent image on the photosensitive body by scanning the laser beam, it may be structured that the image density is obtained by using the total number of laser lighting signals (i.e., video count).

Further, it may be structured that the potential sensor is provided in the vicinity of the photosensitive drum to measure the potential on the drum, thereby obtaining the image density.

Thus, in the color image formation apparatus wherein the plural image support bodies are disposed but the dedicated cleaning device for each of these image support bodies is not disposed in the vicinity of that body, the density of the image to be formed on each image support body is detected, the printing job is temporarily interrupted according to the density of the image formed on any image support body, and it is determined based on the image support body caused the interruption whether the residual toner collection operation for the specific image support body is to be performed or the residual toner collection operation for the plural image support bodies is to be performed. Thus, it is possible to minimize deterioration of productivity and also prevent deterioration of the photosensitive drum caused by the unnecessary cleaning operation.

Further, it is possible to prevent that the toner is mixed with a ferrite carrier acting as a dielectric brush in a charging unit, whereby it is possible to maintain charging performance. Thus, it is possible to prevent image deterioration form a high-quality image.

Thus, in the color image formation apparatus wherein the plural image support bodies are disposed and the dedicated cleaning device for each of these image support bodies is not disposed, the printing job is temporarily interrupted according to the density of the image formed on any image support body, and it is determined based on the image support body caused the interruption whether the residual toner collection operation for the specific image support body is to be performed or the residual toner collection operation for the plural image support bodies is to be performed. Thus, it is possible to minimize deterioration of productivity and also prevent deterioration of the photosensitive drum caused by the unnecessary cleaning operation.

Further, since a development agent collected into each of the respective color development units by the residual toner collection operation can be reused, it is possible to prevent that the development agent is used wastefully, thereby satisfactorily saving the development agents.

In the above-described second embodiment, it is explained the example that the two kinds of flags (i.e., K interruption flag and YMC interruption flag) are used. However, it is possible to use interruption flags corresponding to respective image formation units. Namely, the residual toner collection operation may be performed at independent timing to each of the image formation units by using corresponding one of K, Y, M and C interruption flags.

As explained above, according to the second embodiment, the plural detection means respectively detect the densities of the respective color images formed on the different image support bodies by the printing job, and the control means interrupts the printing job and controls the residual development agent collection operation into the development unit for any one of the image support bodies or the plural image support bodies in accordance with each addition value of each image density detected by the detection means. Therefore, the residual development agent collection operation for the unnecessary image support body is restricted, and the residual development agent collection operation for any one of the image support bodies or the plural image support bodies is performed at the timing according to the image density of each image support body, whereby it is possible to prevent deterioration of productivity and deterioration of the image support body.

Further, the collection means includes a first collection means (charger (magnetic field generation means, sleeve, low-resistance carrier)) which once captures the residual development agent on the image support body, changes its electrostatic characteristic of the captured toner, and brings back the characteristic-changed development agent to the image support body, and a second collection means (development unit) which collects the brought-back development agent. Therefore, it is possible to prevent that the development agent is mixed with the low-resistance ferrite carrier acting as the dielectric brush in the charger, thereby maintaining charging performance.

Further, in the residual development agent collection operation to be performed during interruption of the printing job, the control means controls the charger such that, after the charger ejects the once-captured development agent to the image support body, the charger is controlled to further eject the development agent by driving the sleeve in the state that the magnetic field generation means is not driven. Therefore, even in the residual development agent collection operation during the printing job interruption, it is possible to sufficiently eject the development agent which was used in the high-density image formation and captured into the charger in the development agent collection operation. Thus, it is possible to prevent that the development agent is mixed with the ferrite carrier acting as the dielectric brush in the charger, thereby maintaining charging performance.

Further, in the control method for the image formation apparatus which comprises the respective-color image formation means for developing the latent images formed on the different plural image support bodies for respective color components in the printing job with use of respective color development units and performing the multi-color image formation by transferring the developed latent images on the fed recording media and the respective-color collection means for collecting the residual development agents on the image support bodies into the respective development units, the image density to be formed on each image support body is detected, the printing job is interrupted according to each addition value of the detected image density, and the residual development agent collection operation by the collection means is performed to any one of the image support bodies or the plural image support bodies. Therefore, the residual development agent collection operation to the unnecessary image support body is restricted, and the residual development agent collection operation to any one of the image support bodies or the plural image support bodies is performed at the timing according to the image density of each image support body, whereby it is possible to minimize deterioration of productivity and prevent deterioration of the image support body.

Therefore, it is possible to restrict the residual development agent collection operation to the unnecessary image support body, minimize the deterioration of the productivity and prevent the deterioration of the image support body.

Other Embodiments

As described above, needless to say, the present invention can be completed in a case where a storage medium storing the program codes of a software for realizing the functions of the above-described embodiments is supplied to a system or an apparatus and a computer (CPU or MPU) in the system or apparatus reads and executes the program codes stored in the memory medium.

In such case the program codes themselves read from the storage medium realize the functions of the embodiments, and the storage medium storing such the program codes constitute the present invention.

The storage medium storing such the program codes can be, for example, a floppy disk, a hard disk, an optical disk, a magnetooptical disk, a CD-ROM, a CD-R, a magnetic tape, a non-volatile memory card, a ROM, an EEPROM or the like.

Needless to say, the present invention also includes, not only the case where the functions of the embodiments are realized by the execution of the read program codes by the computer, a case where an OS (operating system) or the like functioning on the computer executes all the process or a part thereof according to the instructions of the program codes, thereby realizing the functions of the embodiments.

Needless to say, the present invention further includes a case wherein the program codes read from the storage medium are once stored in a memory provided in a function expansion board inserted in the computer or a function expansion unit connected to the computer, and a CPU or the like provided in the function expansion board or the function expansion unit executes all the process or a part thereof according to the instructions of such program codes, thereby realizing the functions of the embodiments.

Further, the present invention can be applied to a system constructed by plural equipments or can be also applied to an apparatus comprising one equipment. Also, needless to say, the present invention can be applied to a case where a program is supplied to a system or an apparatus. In this case, by reading the storage medium which stores the program represented by the software to achieve the present invention into the system or the apparatus, the system or the apparatus can derive the effects of the present invention.

Further, by downloading and reading the program represented by the software to achieve the present invention from a data base on a network, the system or the apparatus can derive the effects of the present invention.

The present invention has been described in connection with the several preferred embodiments. The present invention is not limited only to the above-described embodiments, but it is apparent that various modifications and applications are possible within the scope of the appended claims.

What is claimed is:

1. An image formation apparatus comprising:

image formation means for performing image formation by developing a latent image formed on an image support body with use of a development unit and by transferring the developed image onto a fed recording medium;

collection means for collecting a residual development agent on the image support body into the development unit;

detection means for detecting a density of the image to be formed on the image support body; and control means for causing said collection means to perform a residual development agent collection operation, according to a number of image formations of which image density detected by said detection means exceeds a predetermined image density.

2. An apparatus according to claim 1, wherein said collection means includes:

first collection means for once capturing the development agent residual on the image support body, changing its electrostatic characteristic and again ejecting the agent onto the image support body, and second collection means for collecting the ejected development agent into a development unit of corresponding color.

3. An apparatus according to claim 2, wherein said first collection means includes a charger for charging the image support body.

4. An apparatus according to claim 3, wherein said charger includes a magnetic field generator for generating magnetic field, a rotatable sleeve containing said magnetic field generator, and a low-resistance carrier disposed on the periphery of said sleeve and capable of contacting with the image support body with predetermined resistance.

5. An apparatus according to claim 4, wherein said sleeve is rotatable in a direction opposite to a rotational direction of the image support body.

6. An apparatus according to claim 4, wherein said charger charges the image support body by forming a dielectric brush with the low-resistance carrier.

7. An apparatus according to claim 4, wherein, in the residual development agent collection operation to be performed during a printing job interruption, after said charger ejects the once-captured development agent onto the image support body, said control means controls said charger to further eject the development agent by rotatably driving said sleeve in a state that said magnetic field generator is not driven.

8. An apparatus according to claim 2, wherein said second collection means includes development units for respective colors.

9. An apparatus according to claim 1, wherein said detection means detects the density of the image to be formed on the image support body, on the basis of a video count.

10. An apparatus according to claim 9, wherein said image formation means forms the latent image on the image support body by using plural light emission elements arranged along a direction perpendicular to a feed direction of the recording medium, and said detection means uses as the video count the total number of light emission of each light emission element.

11. An apparatus according to claim 9, wherein said image formation means forms the latent image on the image support body by laser beam scanning, and said detection means uses as the video count the total number of laser lighting signals.

12. An apparatus according to claim 1, wherein said detection means measures a potential on the image support body, and then said detection means detects the density of the image to be formed on the image support body, on the basis of the measured potential.

13. An apparatus according to claim 1, wherein said control means calculates an addition value of image densities detected by said detection means, and controls a residual development agent collection operation time by said collection means in accordance with the calculated addition value of the image densities.

14. A control method for an image formation apparatus which comprises image formation means for performing image formation by developing a latent image formed on an image support body with use of a development unit and by transferring the developed image onto a fed recording medium, and collection means for collecting a residual development agent on the image support body into the development unit, said method comprising:

a detection step of detecting a density of the image to be formed on the image support body; and a collection step of causing the collection means to perform a residual development agent collection operation in accordance with a number of image formations of which image density detected in said detection step exceeds a predetermined image density.

15. An image formation apparatus comprising:

image formation means for each color for performing multi-color image formation by developing a latent image of corresponding color formed on corresponding one of plural different image support bodies in a printing job with use of a development unit for corresponding color and by transferring the developed image onto a fed recording medium;

collection means for each color for collecting a residual development agent on the corresponding-color image support body into the corresponding-color development unit;

detection means for each color for detecting a density of the image to be formed on the corresponding-color image support body; and control means for controlling a residual development agent collection operation by said collection means to the specific one image formation means or to the plural image formation means, according to the image densities detected by said detection means.

16. An apparatus according to claim 15, wherein said collection means includes, first collection means for once capturing the development agent residual on the corresponding-color image support body, changing its electrostatic characteristic and again ejecting the agent onto the corresponding-color image support body, and second collection means for collecting the ejected development agent into the corresponding-color development unit.

17. An apparatus according to claim 16, wherein said first collection means includes a charger for charging the corresponding-color image support body.

18. An apparatus according to claim 17, wherein said charger includes a magnetic field generator for generating magnetic field, a rotatable sleeve containing said magnetic field generator, and a low-resistance carrier disposed on the periphery of said sleeve and capable of contacting with the corresponding-color image support body with predetermined resistance.

19. An apparatus according to claim 18, wherein said sleeve is rotatable in a direction opposite to a rotational direction of the corresponding-color image support body.

20. An apparatus according to claim 18, wherein said charger charges the corresponding-color image support body by forming a dielectric brush with the lowresistance carrier.

21. An apparatus according to claim 18, wherein, in the residual development agent collection operation to be performed during a printing job interruption, after said charger ejects the once-captured development agent onto the corresponding-color image support body, said control means controls said charger to further eject the development agent by rotatably driving said sleeve in a state that said magnetic field generator is not driven.

22. An apparatus according to claim 16, wherein said second collection means includes the development units for respective colors.

23. An apparatus according to claim 15, wherein said corresponding-color detection means detects the density of the image to be formed on the corresponding-color image support body, on the basis of a video count.

24. An apparatus according to claim 23, wherein said image formation means forms the latent image on the corresponding-color image support body by using plural light emission elements arranged along a direction perpendicular to a feed direction of the recording medium, and said corresponding-color detection means uses as the video count the total number of light emission of each light emission element.

25. An apparatus according to claim 23, wherein said image formation means forms the latent image on the corresponding-color image support body by laser beam scanning, and said detection means uses as the video count the total number of laser lighting signals.

26. An apparatus according to claim 15, wherein said corresponding-color detection means measures a potential on the corresponding-color image support body, and then said detection means detects the density of the image to be formed on the image support body, on the basis of the measured potential.

27. A control method for an image formation apparatus which comprises image formation means for each color for performing multi-color image formation by developing a latent image of corresponding color formed on corresponding one of plural different image support bodies in a printing job with use of a development unit for corresponding color and by transferring the developed image onto a fed recording medium, and collection means for each color for collecting a residual development agent on the corresponding-color image support body into the corresponding-color development unit, said method comprising:

plural detection steps of each detecting a density of the image to be formed on the corresponding-color image support body; and collection step of causing the collection means to perform a residual development agent collection operation to the specific one image formation means or to the plural image formation means, according to the image densities detected in said detection step.

28. An image formation apparatus comprising:

image formation means for performing image formation by developing a latent image formed on an image support body with use of a development unit and by transferring the developed image onto a fed recording medium;

collection means for collecting a residual development agent on the image support body into the development unit;

detection means for detecting a density of the image to be formed on the image support body; and control means for causing said collection means to perform a residual development agent collection operation, according to an image density detected by said detection means.

29. An apparatus according to claim 28, wherein said collection means includes:

first collection means for once capturing the development agent residual on the image support body, changing its electrostatic characteristic and again ejecting the agent onto the image support body, and second collection means for collecting the ejected development agent into a development unit of corresponding color.

30. An apparatus according to claim 29, wherein said first collection means includes a charger for charging the image support body.

31. An apparatus according to claim 30, wherein said charger includes a magnetic field generator for generating magnetic field, a rotatable sleeve containing said magnetic field generator, and a low-resistance carrier disposed on the periphery of said sleeve and capable of contacting with the image support body with predetermined resistance.

32. An apparatus according to claim 31, wherein said sleeve is rotatable in a direction opposite to a rotational direction of the image support body.

33. An apparatus according to claim 31, wherein said charger charges the image support body by forming a dielectric brush with the low-resistance carrier.

34. An apparatus according to claim 31, wherein, in the residual development agent collection operation to be performed during a printing job interruption, after said charger ejects the once-captured development agent onto the image support body, said control means controls said charger to further eject the development agent by rotatably driving said sleeve in a state that said magnetic field generator is not driven.

35. An apparatus according to claim 29, wherein said second collection means includes development units for respective colors.

36. An apparatus according to claim 28, wherein said detection means detects the density of the image to be formed on the image support body, on the basis of a video count.

37. An apparatus according to claim 36, wherein said image formation means forms the latent image on the image support body by using plural light emission elements arranged along a direction perpendicular to a feed direction of the recording medium; and said detection means uses as the video count the total number of light emission of each light emission element.

38. An apparatus according to claim 36, wherein said image formation means forms the latent image on the image support body by laser beam scanning, and said detection means uses as the video count the total number of laser lighting signals.

39. An apparatus according to claim 28, wherein said detection means measures a potential on the image support body, and then said detection means detects the density of the image to be formed on the image support body, on the basis of the measured potential.

40. An apparatus according to claim 28, wherein said control means calculates an addition value of image densities detected by said detection means, and controls a residual development agent collection operation time by said collection means in accordance with the calculated addition value of the image densities.

* * * * *

UNITED STATES PATENT AND TRADEMARK OFFICE

CERTIFICATE OF CORRECTION

PATENT NO. : 6,256,462 B1
DATED : July 3, 2001
INVENTOR(S) : Yasushi Maeda et al.

It is certified that error appears in the above-identified patent and that said Letters Patent is hereby corrected as shown below:

Column 2,
Line 2, "Job," should read -- job, --.

Column 3,
Line 39, "(referred" should read -- (referred to --.
Line 41, "an" should read -- a --.
Line 43, "referred" should read -- referred to -- .
Line 66, "referred" should read -- referred to --.

Column 4,
Line 58, "charges" should read -- charge --.

Column 5,
Line 1, "Numeral 338 and 339 denotes" should read -- Numerals 338 and 339 denote --, and "fed" should read -- feed --.
Line 30, "fixing" should read -- fixes --.
Line 33, "Numerals 353 denote" should read -- Numeral 353 denotes --.
Line 34, "eliminates" should read -- eliminate --.

Column 6,
Line 12, "charge eliminated" should read -- charge-eliminated --.
Line 24, "charge" should read -- charge- --.

Column 7,
Line 7, "SH" should read -- S/H --.
Line 16, "AID" should read -- A/D --.
Line 20, "SH and AD" should read -- S/H and A/D --.

Column 8,
Line 51, "SH" should read -- S/H --.

Column 10,
Line 61, "copes" should be deleted.

UNITED STATES PATENT AND TRADEMARK OFFICE

CERTIFICATE OF CORRECTION

PATENT NO. : 6,256,462 B1
DATED : July 3, 2001
INVENTOR(S) : Yasushi Maeda et al.

It is certified that error appears in the above-identified patent and that said Letters Patent is hereby corrected as shown below:

Column 11,
Line 53, "end," should read -- ends, --.

Column 14,
Line 63, "caused" should read -- caused by --.

Column 15,
Line 2, "caused" should read -- caused by --.
Line 32, "a" should read -- an --.
Line 59, "a" should read -- an --.

Column 17,
Line 20,"caused" should read -- caused by --.
Line 32, "form" should read -- forming --.
Line 39, "caused" should read -- caused by --.

Column 21,
Line 32, "includes," should read -- includes: --.
Line 56, "lowresistance" should read -- low-resistance --.

Signed and Sealed this

Eighteenth Day of June, 2002

*Attest:*

*Attesting Officer*

JAMES E. ROGAN
*Director of the United States Patent and Trademark Office*